US007527708B2

(12) United States Patent
Gustavsson

(10) Patent No.: US 7,527,708 B2
(45) Date of Patent: May 5, 2009

(54) SUPPORT BODY, HOLDING DEVICE THEREFOR, APPARATUS WITH SAID BODY FOR TREATMENT OF A WEB, AND METHODS OF FORMING AN EXTENDED NIP IN THE APPARATUS AND CONTROLLING LOAD IN THE NIP

(75) Inventor: Tord Gustav Gustavsson, Forshaga (SE)

(73) Assignee: Metso Paper Karlstad AB, Karlstad (SE)

( * ) Notice: Subject to any disclaimer, the term of this patent is extended or adjusted under 35 U.S.C. 154(b) by 406 days.

(21) Appl. No.: 11/408,340

(22) Filed: Apr. 21, 2006

(65) Prior Publication Data

US 2006/0254437 A1 Nov. 16, 2006

Related U.S. Application Data

(63) Continuation-in-part of application No. PCT/SE2004/001485, filed on Oct. 15, 2004.

(30) Foreign Application Priority Data

Oct. 21, 2003 (SE) ..... 0302767-9

(51) Int. Cl.
*D21F 3/06* (2006.01)
*B32B 5/02* (2006.01)

(52) U.S. Cl. ..... 162/358.3; 162/205; 100/156

(58) Field of Classification Search ..... 162/204–207, 162/358.1, 358.3, 358.5, 220, 405; 100/37, 100/38, 153, 156, 160, 170; 492/20
See application file for complete search history.

(56) References Cited

U.S. PATENT DOCUMENTS 3,293,121 A * 12/1966 Martin ..... 162/358.3
3,839,147 A 10/1974 Daane
4,468,287 A 8/1984 Dahl
4,576,682 A * 3/1986 Laapotti ..... 162/358.3
4,851,119 A 7/1989 Berglöff et al.
5,614,064 A * 3/1997 Nykopp ..... 162/358.3
5,951,824 A 9/1999 Deshpande
5,980,693 A 11/1999 Liang et al.

(Continued)

FOREIGN PATENT DOCUMENTS

DE 30 30 233 2/1982

(Continued)

*Primary Examiner*—Eric Hug
(74) *Attorney, Agent, or Firm*—Alston & Bird LLP

(57) ABSTRACT

A support body for an apparatus having an extended nip defined between a contact surface of an elastically deformable support body and an opposed surface, the support body comprising a pressure chamber or several pressure chambers arranged to be pressurized for loading the nip via the contact surface. The support body can be provided with a holding device that forms a counter support for the pressure chamber or pressure chambers except at the side facing the contact surface. A method of forming the extended nip in the apparatus entails applying a pressure in at least one pressure chamber of the support body and expanding elastically deformable side portions of the support body. A further method of controlling the load in the extended nip entails designing the support body with several pressure chambers and setting the pressures in the pressure chambers in accordance with a predetermined pattern.

51 Claims, 9 Drawing Sheets

U.S. PATENT DOCUMENTS

| | | | |
|---|---|---|---|
| 6,334,933 | B1 | 1/2002 | Koski |
| 6,387,216 | B1 | 5/2002 | Koski |
| 6,835,283 | B2 | 12/2004 | Weigant et al. |

FOREIGN PATENT DOCUMENTS

| | | |
|---|---|---|
| DE | 44 05 587 | 9/1994 |
| EP | 0 575 353 | 8/1995 |
| EP | 1 319 744 | 6/2003 |
| WO | WO 02/44467 | 6/2002 |

* cited by examiner

SUPPORT BODY, HOLDING DEVICE THEREFOR, APPARATUS WITH SAID BODY FOR TREATMENT OF A WEB, AND METHODS OF FORMING AN EXTENDED NIP IN THE APPARATUS AND CONTROLLING LOAD IN THE NIP

CROSS-REFERENCE TO RELATED APPLICATIONS

The present application is a continuation-in-part of International Patent Application PCT/SE2004/001485 filed on Oct. 15, 2004, which designated inter alia the United States of America and was published under PCT Article 21(2) in the English language.

BACKGROUND OF THE INVENTION

The present invention relates to a support body for an apparatus having an extended nip defined between a contact surface of the support body and an opposed surface.

The previously known presses with an extended press nip have a so-called press shoe, which consists of a metallic material, such as aluminium or steel, and are designed with a press surface, usually a concave press surface, whose profile is very accurately adapted to the opposed counter-pressure surface. Such a press shoe is very complicated to manufacture and therefore involves a very high cost. Due to the fact that it consists of metal, it is relatively rigid and inflexible. The press roll acting as a counter roll of such a shoe press can have a relatively thick cylinder wall which withstands the forces from the press shoe. In accordance with another embodiment of the counter roll, it has a relatively thin cylinder wall and is provided internally with a counter-pressure system for adjustable crowning of the thin and, thus, deformable cylinder wall or shell in dependence of the forces the press shoe has to apply on the counter roll in order to obtain the desired load. Also the press shoe can be crowned in accordance with the crowning of the counter roll, and it will then be usable only in combination with this counter roll. Alternatively, the metallic press shoe can be tilted by means of hydraulic cylinders.

A Yankee cylinder has a cylinder wall or shell which is relatively thin, and which easily is deformed by impression of the press shoe when the Yankee cylinder is used as a counter roll. The deformation of the shell varies in an axial direction from the central region in a direction towards the end walls, where the impression is substantially smaller than within the central region. Therefore, the press shoe will act with a higher pressure at and in the vicinity of the end walls, resulting in an increased wear at the edges of the press felt and an irregular load profile along the press shoe, something which in its turn results in variable paper properties crosswise to the machine direction. It has been proposed to crown the shell of the Yankee cylinder by means of an internal counter-pressure system, or to arrange two or more rows of hydraulic cylinders on the underside of the press shoe for influencing the press shoe to conform to the deformed surface, in both cases in order to achieve a more uniform load profile. Both proposals, however, are complicated and expensive to carry out.

The following documents are examples of presses having extended press nips.

DE 44 05 587 and WO 02/44467 describe a press having a hydrostatic bearing, including a press shoe 3 or double press shoes 3a, 3b of the same design. A press belt 6 rotates on top of a lubricating fluid bed of the press shoe 3 with a very small friction. The press shoe, which is made of metal, has a pressure chamber 10 containing a hydraulic fluid, preferably water. A rectangular pressure-equalizing membrane 20, consisting of a suitable solid material, preferably stainless steel, is fixed on the press nip side of the press shoe. The pressure-equalizing membrane 20 has an outer edge 26, an inner edge 22, and an opening 27 that is defined by the inner edge 22. The pressure-equalizing membrane 20, thus looking like a frame, is flexible so that an edge zone 21, standing in direct contact with the hydraulic fluid, can deflect when pressure differences occur between its two sides. These pressure differences arise when hydraulic fluid happens to leak out through the press nip as a result of irregularities in the paper web and/or in the envelope surface of the counter roll. Thus, the flexible pressure-equalizing membrane 20 creates a self-adjusting nip 2, having no or only a minimum of fluid leakage. Thus, through the opening 27 in the pressure-equalizing membrane 20, the pressure fluid in the pressure chamber 10 stands in direct contact with the movable belt. The complementary addition which has been done in said WO-publication in comparison to said DE-publication is that the flexible membrane has been provided with "pinholes 25" within its free edge zone 21 in order to conduct hydraulic fluid from the pressure chamber 10 to the belt 6 for the purpose of lubricating the belt.

U.S. Pat. No. 5,980,693 describes presses having a tube-shaped or inflatable loading element, but with a metal shoe between the loading element and the inside of the belt. Furthermore, this part of the shoe is constructed in order to provide a slow reduction of the pressure in nip outlet. Normally, an abrupt pressure drop is desired.

U.S. Pat. No. 3,839,147 describes a shoe press having two opposed shoes. Each shoe has a metal bottom and sills, sealing against the inside of the belt. The side of the shoe facing the belt is a perforated diaphragm, which causes the pressure of the hydraulic fluid in a pressure chamber to load the inside of the belt directly. The shoe is of a rather complicated construction with various apertures and reinforcements.

U.S. Pat. No. 5,951,824 describes an ordinary shoe having ordinary hydraulic loading elements. The shoe is coated with a soft and durable layer of polymer or rubber in order to reduce the risk of damages to the belt and shoe from paper wads passing through the press nip.

EP 0 575 353 describes a press having a shoe, which is loaded with bellows being arranged inside a metal cover of the shoe, wherein a belt slides around said metal cover.

U.S. Pat. No. 6,334,933 describes a press having a counterpart of metal, which is provided with a plurality of pressure pockets being sealed by a metal plate and hoses, which also can contribute to loading the opposite portions of the press nip.

U.S. Pat. No. 6,387,216 describes a press having an open fluid chamber, over which a belt is running and which is loading the press nip. The chamber is sealed by means of setting the belt under pressure, so that it is tightened over the edges of the chamber.

EP 1 319 744 describes a method for measuring and regulating the nip pressure in a shoe press, crosswise to and along the web, by means of measuring and continuously adapting the hydraulic static pressure in reference points above measurement holes in the press nip.

DE 30 30 233 describes an elastic slide shoe which is attached to a stand of metal. The slide shoe includes a solid body or a hollow body in the form of a hose which can be filled with a pressure medium. The hose is surrounded by an elastic belt which is attached to the metal stand. The hollow body may be divided into chambers which can be pressurized to different pressures. However, a change of pressure in the chamber or chambers does not result in a change of the loading in the nip because of the fact that the hollow body is permitted to expand laterally during every such increase of pressure.

BRIEF SUMMARY OF THE INVENTION

It is an object of the invention to provide an elastic support body which, in relation to known support bodies, can be manufactured in a more simple way, without any special machining and without any major consideration to the shape of the opposed surface which it is to work against, and which can provide a loading profile in dependence of the pressure in the pressure chamber or pressure chambers in the same way or even in a better way than what is possible with a conventional support body of metal with one or more rows of pressure pockets which are closed by a running belt.

A support body according to one embodiment of the invention is characterized in that it is provided with a holding device arranged to form a counter support for the pressure chamber or the pressure chambers, respectively, except at the side of the pressure chamber or pressure chambers, respectively, facing said contact surface.

The holding device according to the invention is characterized in that it has a space for receiving the support body in order to form an outer counter support for all surfaces of the support body, as seen circumferentially, except its contact surface, and/or is entirely or partially embedded in the support body in order to form an inner counter support for the pressure chamber or the pressure chambers, respectively, except at the side facing said contact surface.

The apparatus according to the invention is characterized in that the support body is provided with a holding device arranged to form a counter support for the pressure chamber or the pressure chambers, respectively, except at the side of the pressure chamber or pressure chambers, respectively, facing said contact surface, whereby, in the operation of said apparatus and the support body being in a nip-forming operation position, the support body is arranged such that a change of the pressure in said pressure chamber or in at least one of said several pressure chambers produces a corresponding change of pressure in the nip with accompanying changed press curve.

A press according to one embodiment of the invention is characterized in that the press body is provided with a holding device arranged to form a counter support for the pressure chamber or the pressure chambers, respectively, except at the side of the pressure chamber or pressure chambers, respectively, facing said press surface, whereby, in the operation of the press and the press body being in a nip-forming operation position, the press body is arranged such that a change of the pressure in said pressure chamber or in at least one of said several pressure chambers produces a corresponding change of pressure in the nip with accompanying changed press curve.

A method of forming an extended nip according to one embodiment of the invention is characterized by the steps of:

- mounting the support body in a holding device which forms counter support for a top portion and side portions of the support body;
- applying an increased pressure in said pressure chamber or in at least one of said several pressure chambers; and
- moving a top portion of the support body, exhibiting said contact surface, in a direction towards the opposed surface under the influence of said increased pressure, by means of expansion of said side portions of the support body, said side portions being elastically deformable and connected to the top portion.

A method of controlling the load in an extended nip according to one embodiment of the invention is characterized by the steps of:

- mounting the support body in a holding device, which forms a counter support for a bottom portion and side portions of the support body; and
- setting the pressures in the pressure chambers in accordance with a predetermined pattern to obtain a desired press curve.

The expression "nip" is to be interpreted in its broadest meaning in order to encompass such a nip that is defined by a wire and support body.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The invention will be described in connection with a press for dewatering a fibre web. Naturally, in addition to the press section, the invention can be applied to any suitable apparatus for the treatment of a fibre web, e.g. an apparatus in a drying or forming section of a paper or board machine, and in a calender for surface treatment of the fibre web.

Figure 2:
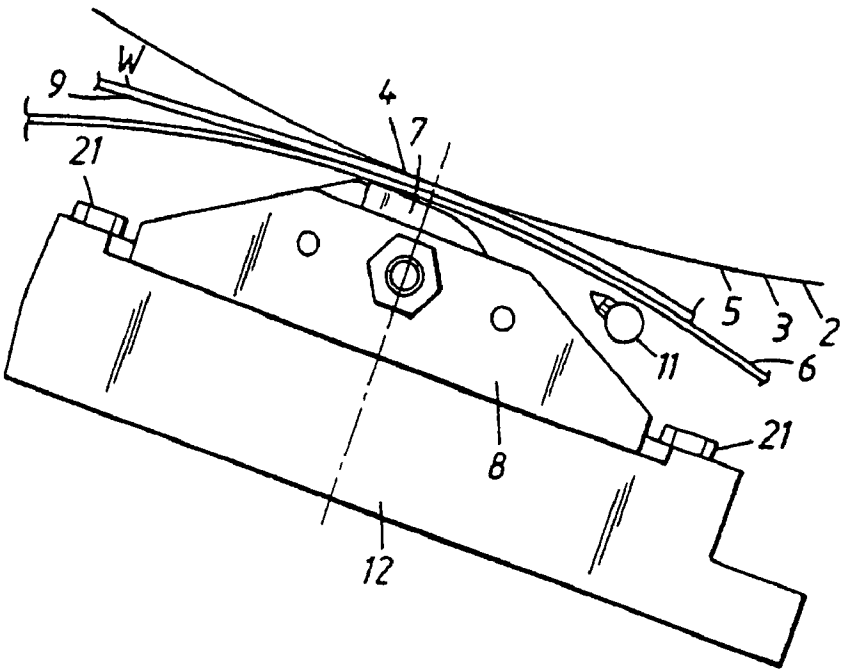
FIG. 2 shows the press nip with a press body according to FIG. 1 and its holding device in magnification.
Figure 1:
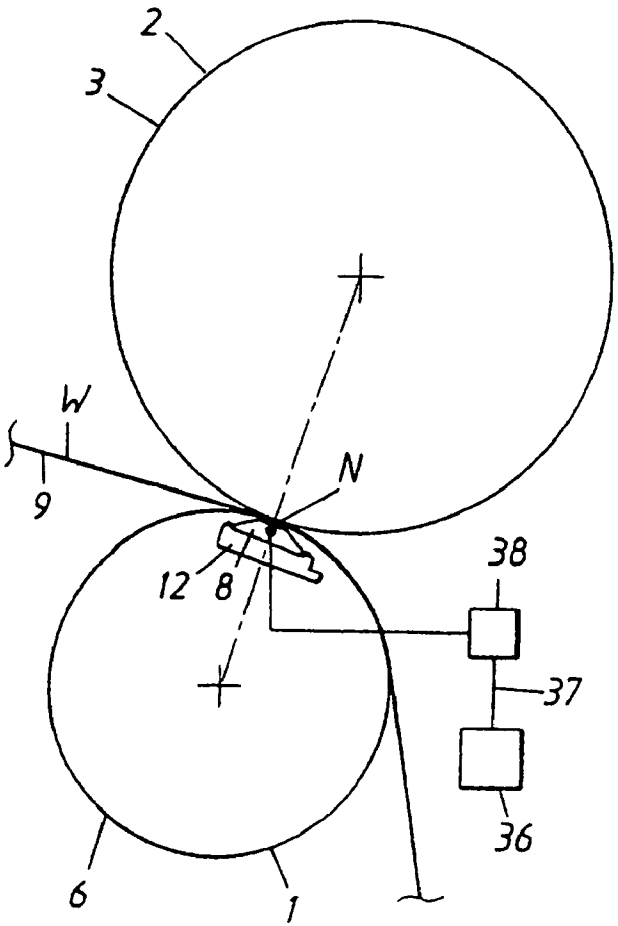
FIG. 1 shows a press according to the invention with a press body according to a first embodiment.

FIGS. 1 and 2 show schematically portions of a press, which is arranged in the press section of a paper or board machine in order to press water out of a formed, wet fibre web. Advantageously, the invention can be used in a paper machine of the tissue machine type. The press includes a first press element 1 and a second press element 2. The press elements 1, 2 are interacting with each other in order to form an extended press nip N.

The second press element 2 includes a counter-pressure member being active in the press nip N and having a movable, endless surface 3, which forms an opposed surface or counter-pressure surface 4, which can be curved or linear, within the press nip N. In the shown embodiment of the press, the second press element 2 consists of a counter roll in the form of a press roll. The counter roll also can be a drying cylinder in a conventional drying section, or a drying cylinder in a tissue machine designated Yankee cylinder. In this case, the counter-pressure member includes the cylindrical wall 5 of the counter roll 2 the envelope surface of which forms said movable, endless surface 3, which within the extended press nip N forms said counter-pressure surface 4, which can be at room temperature or a temperature raised by means of heating. Provided that the cylinder wall 5 is thick and stable enough, it constitutes the counter-pressure member as such. In the case when the cylinder wall 5 is thin and deformable, the counter-pressure member further includes an internal supporting system (not shown), which provides the necessary counter-force.

The first press element 1 includes a movable, endless belt 6 of a flexible material, a support body 7 in the form of a press body, a holding device 8 for mounting the press body 7, a support for mounting the holding device 8, and a loading means for activating the press body 7. The movable belt 6 describes a closed loop inside of which the press body 7 and the support are located. Before the press nip N, the movable belt 6 is arranged for meeting a press felt 9 carrying a wet fibre web W which is to be dewatered when it passes through the extended press nip N. The loading means is arranged for being activated in order to influence the press body 7 during the operation of the press for obtaining pressure forces which the press body 7 exerts against the counter roll 2 via the belt 6, the press felt 9 and the web W. The press body 7 is arranged for deciding the length of the extended press nip N, as seen in the machine direction. The press body 7 has a free sliding surface 10 with which the rotating belt 6 is in sliding contact during the operation of the press, whereby the sliding surface 10 entirely or partially forms a contact surface or press surface 13, which together with said counter-pressure surface 4 defines the press nip N. A spraying device 11 is mounted upstream the press body 7 for supplying lubricant on the inside of the belt in order to form a film which reduces the friction between the rotating belt 6 and the press body 7.

In the shown embodiment of the press, the first press element 1 consists of a press roll, the shell of which forms the movable belt 6 which thus describes a substantially circular loop. In an alternative embodiment of the press (not shown), the flexible, movable belt is arranged for running in a non-circular loop, e.g. in a substantially oval loop or in a substantially triangular loop, around the press body and one or several guide rolls. In the embodiment shown, the press roll 1 has two circular, rotatably mounted end walls (not shown), whereby the shell 6 is rigidly mounted to the peripheries of the end walls in order to rotate together with them. The shell 6 and the end walls define a closed space in which the support is located, said support including a stationary supporting beam 12 extending axially between the end walls without touching them. Also the press body 7 and its holding device 8 are extending axially between the end walls without touching them. Alternatively, the second press element 2 can be of the same or substantially the same design as the above-described first press element 1, whereby the press nip thus is formed by two press bodies according to the invention.

The press body 7 is elastically deformable and has its press surface 13 adaptable to the counter-pressure surface 4 in interaction with this. This adaptation takes place under the influence of a load being created by said loading means, on the press body 7 in a direction towards the counter-pressure surface 4 in order to load the entire press nip N correspondingly. The definition that the press body is elastically deformable does not necessarily imply that the entire press body consists of an elastic material, but should in the context of the invention be seen in a broader sense, namely that the press body has at least one functional portion consisting of an elastic material and fulfilling said definition. For practical and production-engineering reasons, and according to the most preferred embodiments the press body is in its entirety made of an elastic material (or several).

Figure 3:
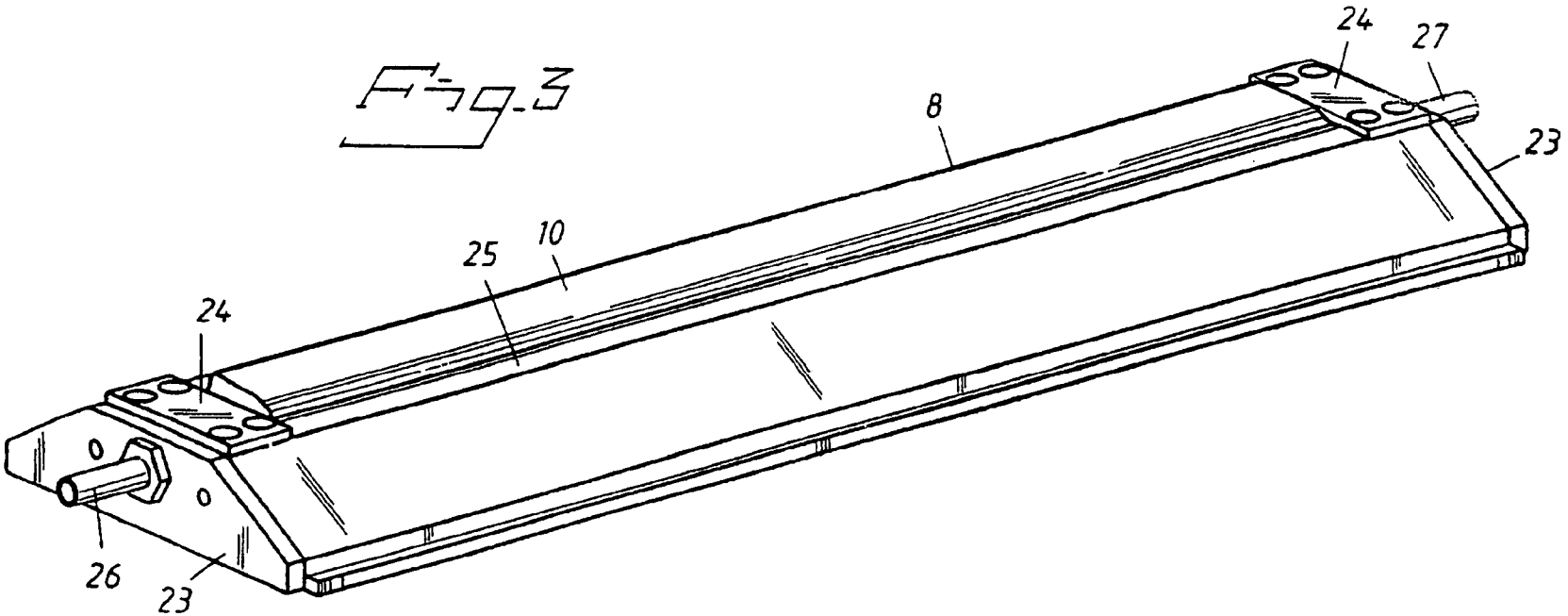
FIG. 3 is a perspective view of the press body and the holding device according to FIG. 2.
Figure 4:
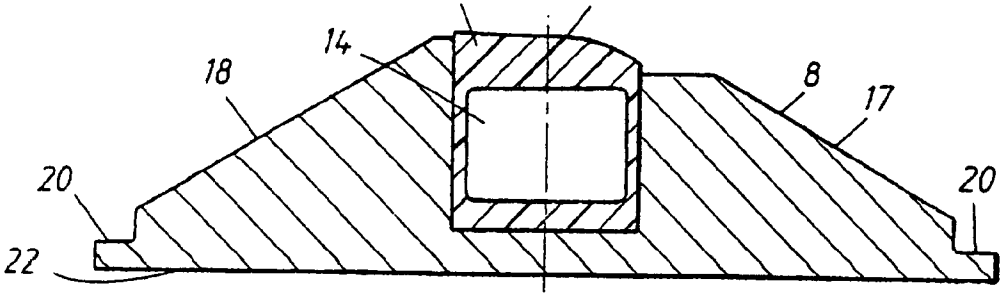
FIG. 4 is a cross-section of the press body and the holding device according to FIG. 3.
Figure 5:
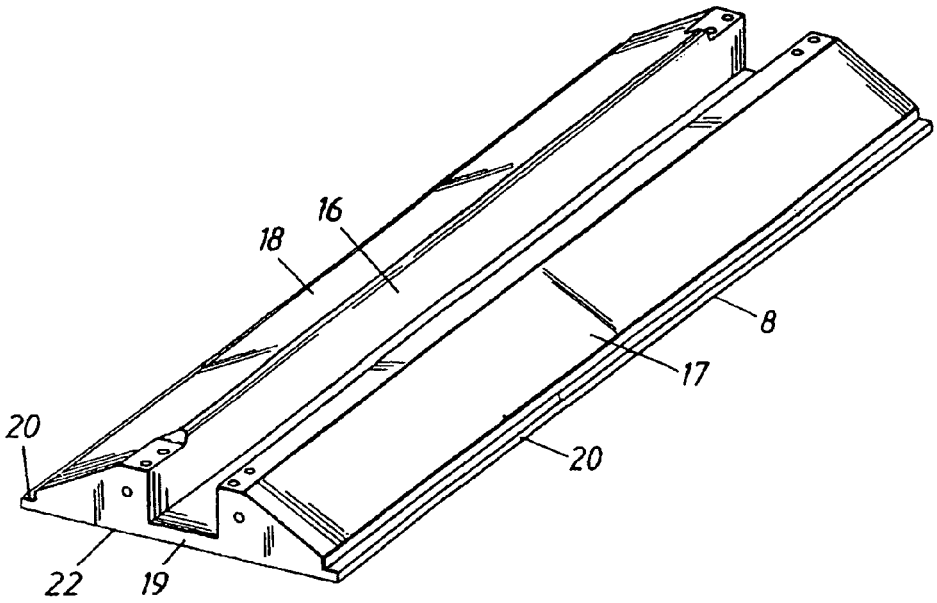
FIG. 5 is a perspective view of the holding device according to FIG. 3, without the press body.
Figure 6:
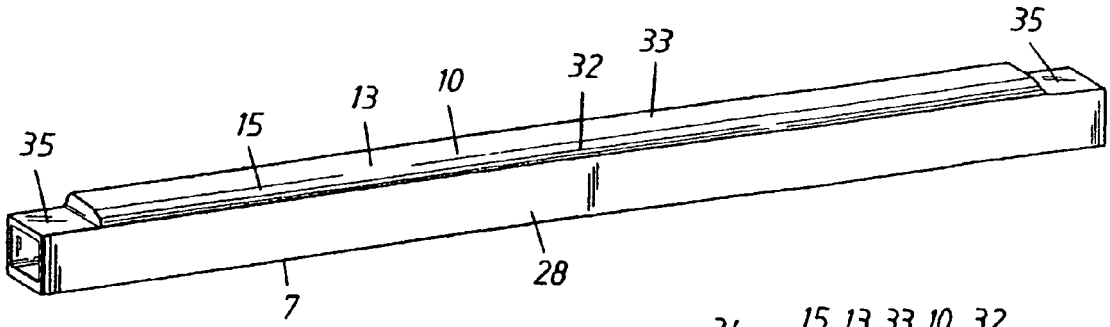
FIG. 6 is a perspective view of the press body according to FIG. 3.
Figure 7:
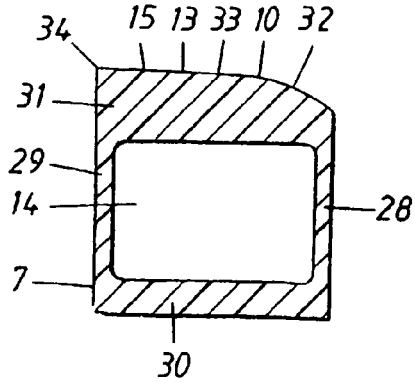
FIG. 7 is a cross-section of the press body according to FIG. 6.

According to the invention, the press body 7 includes one or several closed pressure chambers, said pressure chamber or pressure chambers being part of said loading means. In accordance with FIG. 7, the press body 7 includes a single, larger pressure chamber 14, defining an opposed press zone 15 of the press surface 13. The press body 7 and its holding device 8, being part of the press according to FIG. 1, are shown in greater detail in FIGS. 3 and 4, whereas these two structural elements are shown separately in detail in FIGS. 6 and 7 and FIG. 5, respectively. As is evident from FIG. 5, the holding device 8 includes an elongated, beam-formed holder 22, which is form-stable and provided with an axially through-going channel 16 having a U-shaped or rectangular cross-section and being defined by two side support portions 17, 18 and a bottom support portion 19 connecting them. Opposite mounting flanges 20 are formed at the side support portions 17, 18 for detachable fixing of the holder 22 to the supporting beam 12 by means of bolts 21, as shown in FIG. 2. Furthermore, it is evident from FIG. 3 that the holding device includes two end plates 23 for detachable mounting to the opposed, parallel end surfaces of the holder 22 as well as two clamping plates 24 for detachable mounting on top of the side support portions 17, 18. As is evident from FIGS. 3 and 4, the side support portion 17, being intended to be located at the inlet of the press nip N, is provided with a recess 25 extending between the clamping plates 24 in order to expose the press body 7. One of the end plates 23 is provided with a centrally positioned connecting member 26, forming an inlet for a pressure medium in gas or liquid form, preferably hydraulic oil. The other end plate 23 is provided with a similar connecting member 27, forming an outlet for deaeration of the pressure chamber 14 when hydraulic oil is used. FIGS. 6 and 7 show the press body 7, which is intended to be mounted in the channel 16 of the holder 22 and which has a cross-section being adapted to the cross-section of the channel 16, so that no play arises between opposite lateral surfaces and so that the press body 7 with its bottom surface comes to rest against the bottom surface of the channel 16. In this embodiment, the press body 7 is provided with a through-hole, which is arranged for being sealed at the ends in order to form said pressure chamber 14, having a generally rectangular cross-section. The pressure chamber 14 is defined by the two parallel side walls 28, 29, the bottom wall 30, and the top wall 31 of the press body 7. In the embodiment shown in FIGS. 6 and 7, the two side walls 28, 29 have the same thickness. The top wall 31 forms said free sliding surface 10, which will be facing the counter roll 2, and with which the rotating belt 6 will be in sliding contact during operation. In a cross-sectional view, the sliding surface 10 is designed with a predetermined arch-shape in order to form an initial, curved surface portion 32 having a predetermined radius, and a surface portion 33 being tangential to the curved surface portion 32 and extending up to the sharp corner 34 which the sliding surface 10 forms with the outside of the side wall 29 being fixed in the machine direction. The purpose of the curved surface portion 32 is to create a wedge between the rotating belt 6 and the curved surface portion 32 in order to make it possible to get lubricant to follow the belt 6 on its inside while forming a film between the belt 6 and the sliding surface 10. The above-mentioned corner 34 forms the outlet of the press nip N, while the inlet of the press nip N at the curved surface portion 32 becomes floating depending on the pressure prevailing in the pressure chamber 14. The press body 7 has end portions 35 which lack said sliding surface 10, since the top wall 31 here has been made narrower, i.e. recessed and uniform. The end portions 35 enable a simple, detachable mounting in the holder 22 by means of said clamping plates 24, as is evident from FIGS. 2 and 3. Accordingly, in this assembly, the two connecting members 26, 27 will run into the pressure chamber 14. Cuplike sealings (not shown) are positioned in the pressure chamber 14 at the end portions 35 in order to seal internally against these, and against the end plates 23 and the connecting members 26, 27. In the shown embodiment according to FIGS. 1-7, the loading means includes said pressure chamber 14 and a pressure medium source 36 being connected to the pressure chamber 14 via a pipe 37 and said connecting member 26. The pressure in the pressure chamber 14 is regulated by means of suitable control devices 38.

As mentioned in the foregoing, the press body 7 is elastically deformable in order to expand, under the influence of an increased pressure in the pressure chamber 14, and bring the top wall 31 with its press surface 13 in a direction towards the counter-pressure surface 4 of the counter roll. As is evident from FIGS. 6 and 7, the press body 7 is made in one piece of an elastic material. The press body 7 is mounted in a starting position with its press surface 13 situated at a predetermined, touch free distance from the opposite counter-pressure surface 4. When the press is put into operation, the pressure in the pressure chamber 14 is increased in order to obtain a nip-forming operation position. The increase of pressure causes the press body 7 to expand elastically in relation to the holding device 8 in a direction towards the counter-pressure surface 4 of the counter roll 2, since the side walls 28, 29 have the freedom to stretch or expand elastically until counter-forces arise from the counter-pressure surface 4 of the counter roll 2. These counter-forces first appear at the outlet of the press nip, i.e. just opposite the side wall 28, and then propagates successively in a direction towards the inlet of the press nip, the position of which is determined by the maximum pressure value which is pre-set for a desired load. Accordingly, during said elastic expansion of the press body 7, the top wall 31, and the rotating belt 6 abutting against the top wall 31, will be pressed in a direction towards the counter roll 2, wherein the top wall 31 is elastically deformed both in the machine direction MD and crosswise to the machine direction CD in dependence of the shape of the counter-pressure surface 4, i.e. the press surface 13 conforms to and adopts the outline of the counter-pressure surface 4, and the portion of the sliding surface 10 defining the press nip, i.e. the press surface 13, which in this case corresponds to said press zone 15, changes its form in accordance with the opposed counter-pressure surface 4 of the counter roll 2. Alternatively, the press body 7 is mounted in a first starting position with its press surface 13 situated at a touch free distance from the corresponding counter-pressure surface 4. The press body 7 and the holding device 8 are together moved from the first starting position by means of a suitable movement transmitting device to a second starting position with the press surface 13 of the press body 7 in contact or nearly in contact with the opposite counter-pressure surface 4. The pressure is then increased in the pressure chamber for attaining a nip-forming operation position and the desired pressure curve.

Figure 8:
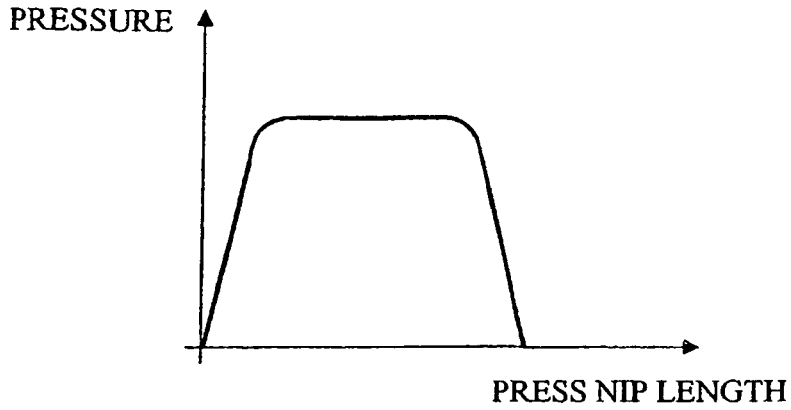
FIG. 8 is a graph depicting the pressure curve obtained with the press body according to the first embodiment.

The press body 7, being used in the embodiments according to FIGS. 1-7, achieves a load profile or pressure curve as illustrated in FIG. 8.

Figure 9:
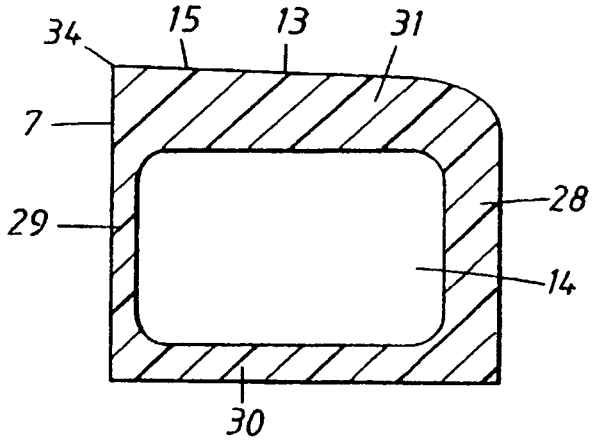
FIG. 9 shows a press body according to a second embodiment.
Figure 10:
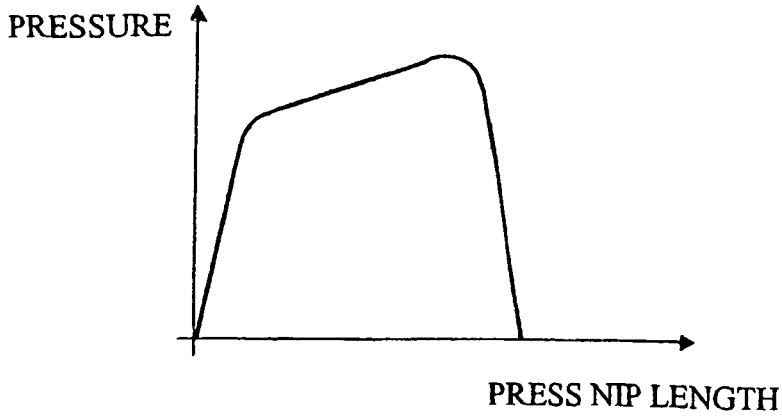
FIG. 10 is a graph depicting the pressure curve which is obtained with the press body according to FIG. 9.

Also in the embodiment according to FIG. 9, the press body 7 is made in one piece, but with the upstream side wall 28 being slightly thicker than the downstream side wall 29. Thereby, the thicker side wall 28 provides a larger resistance against elastic expansion than the thinner side wall 29, when a pressure is applied in the pressure chamber 14, implying that the pressure forces acting in the initial part of the press nip N become smaller than in the final part of the press nip, so that the load profile or pressure curve describes a more flat course, as illustrated in FIG. 10. This effect can also be achieved by means of making the side walls equally thick, but of materials having different coefficients of elasticity, so that the downstream side wall becomes more elastic and more stretchable than the upstream side wall.

Figure 11:
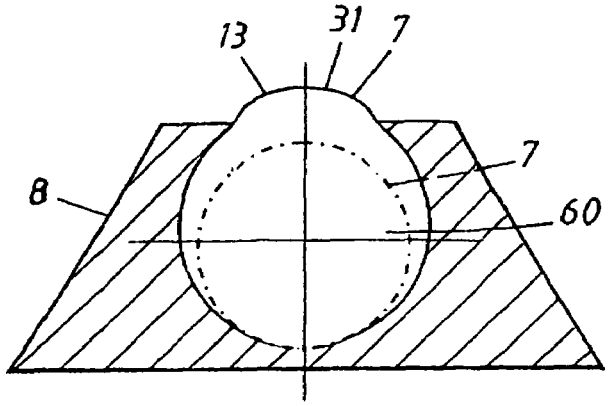
FIG. 11 shows a press body according to a third embodiment.

FIG. 11 shows a press body 7 with a circular cross-section, exhibiting the form of an elastic hose which is sealed at the ends and whose internal space forms a pressure chamber 60. The channel 16 of the holding device 8 has a corresponding or substantially corresponding rounded shape, so that the rounded channel wall forms a counter support for the hose, when it is set under pressure and brought to expand so that the upper, free portion or top wall 31 is pressed out through the upwardly open channel 16, and forms a support in accordance with the principles of the invention.

Figure 12:
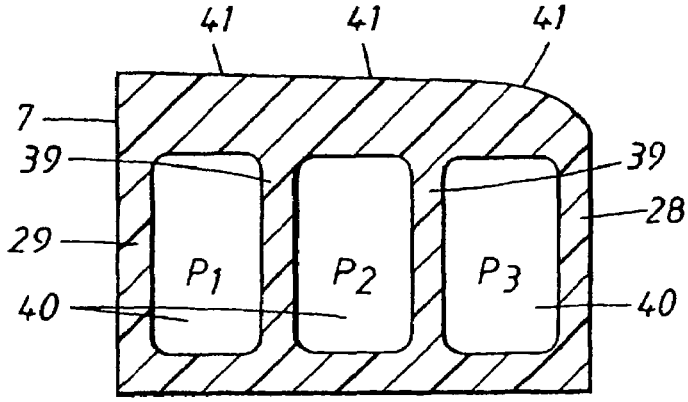
FIG. 12 shows a press body according to a fourth embodiment.
Figure 13:
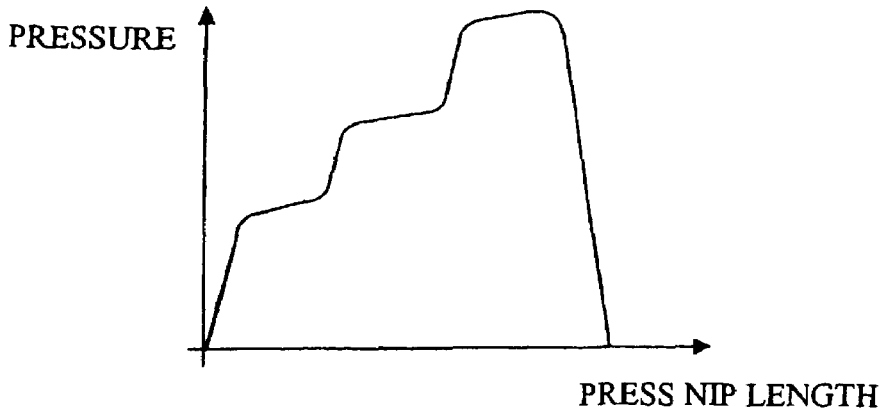
FIG. 13 is a graph depicting the pressure curve which can be obtained with the press body according to FIG. 12.

FIG. 12 shows a press body 7 which is similar to the one in FIG. 7, but which, furthermore, is provided with two elastically deformable, longitudinal, vertical partition walls 39 which, accordingly, are parallel to the side walls 28, 29 and are defining three smaller pressure chambers 40 being connected to the pressure medium source 36 in order to enable them to be set under different pressures $p_1$, $p_2$, $p_3$, independently of each other, for the regulation of the load within the nip. For example, the pressure relation can be chosen to be $p_1<p_2<p_3$, wherein the press body 7 according to this example will achieve a load profile or pressure curve describing a stepped course, as illustrated in FIG. 13. Each pressure chamber 40 defines an opposed press zone 41 of the press surface 13.

Figure 14:
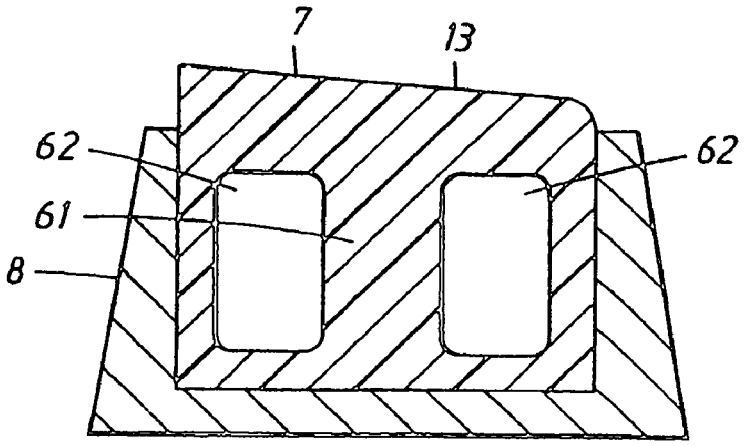
FIG. 14 shows a press body according to a fifth embodiment.

FIG. 14 shows a press body 7 which is similar to the one in FIG. 12, but which is provided with an elastically deformable, longitudinal, vertical partition wall 61, defining two pressure chambers 62 which are connected to the pressure medium source 36 in order to be set under different pressures, independently of each other, for the regulation of the load within the nip. The partition wall 61 is relatively thick in order to be capable of withstanding the pressure it is subjected to, when such a large pressure difference is present between the two pressure chambers that a deflection of the partition wall 61 otherwise would occur.

Figure 15:
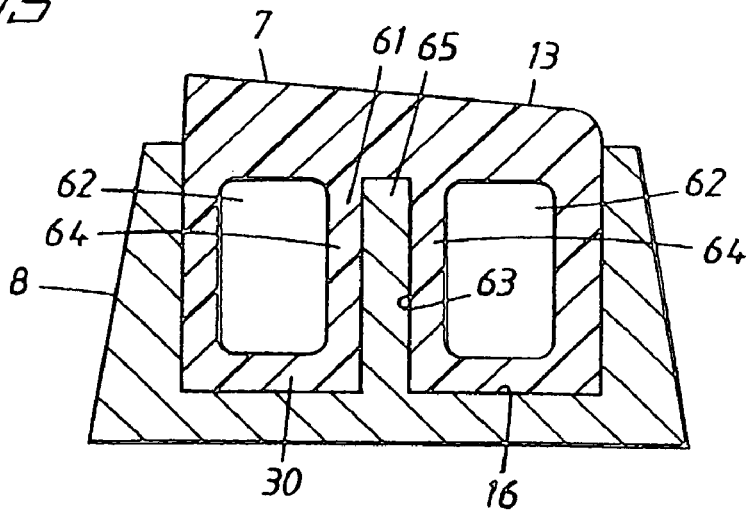
FIG. 15 shows a press body according to a sixth embodiment.

FIG. 15 shows a press body 7 which is similar to the one in FIG. 14, but which is provided with a downwardly open groove 63, extending away from and through the bottom wall 30 and up through the entire partition wall, which thereby is divided into two smaller wall portions 64. The holding device 8 is designed or provided with a reinforcement wall 65, extending upwards from the bottom of the channel 16 and having a rectangular cross-section corresponding to the one of the groove 63. The reinforcement wall 65 consists of a rigid material, e.g. by means of being formed integral with the shape-permanent holding device 8. The reinforcement wall 65 ensures that the pressures in the two pressure chambers 62 do not influence each other via the partition wall 61 when large pressure differences are present. Such a reinforcement of the partition walls can also be obtained with form-stable square profiles (not shown), for instance, which are positioned within each pressure chamber of a press body, for instance, according to FIG. 12, and supporting against all surfaces of the pressure chambers, the side of the profile facing the press surface 13 having holes or apertures so that the pressure in the pressure chamber is allowed to act against the top wall 31.

Figure 16:
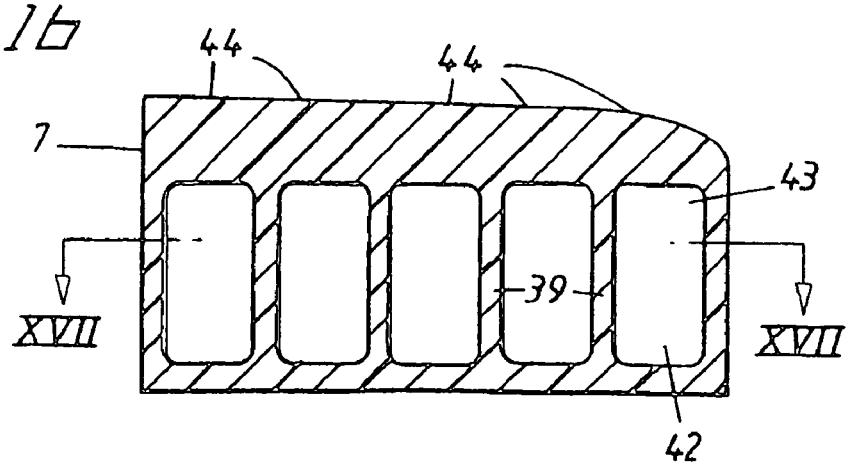
FIGS. 16 and 17 show a press body according to a seventh embodiment.
Figure 17:
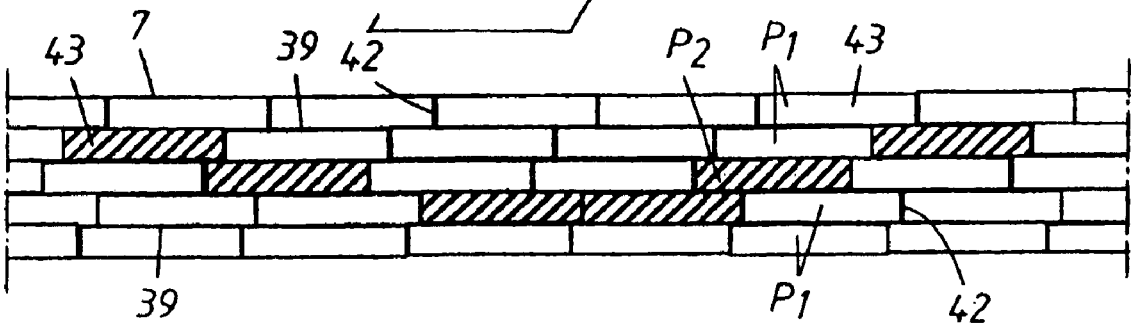

FIG. 16 shows a portion of a press body 7 which is similar to the one in FIG. 12, but which is provided with four elastically deformable, longitudinal, vertical partition walls 39. As is evident from FIG. 16, the press body 7 further is provided with a plurality of elastically deformable, transversal, vertical partition walls 42, being displaced in relation to each other and, together with the longitudinal partition walls 39, defining a plurality of cellular pressure chambers 43, which are connected to the pressure medium source 36 in order to enable them to be set under different pressures by sections or groups, independently of each other, for the regulation of the load within the nip. In the shown example, the cells 43 are arranged in two groups with different pressures $p_1$, $p_2$, wherein the pressure relation of the cell groups, for example, is $p_1<p_2$. The cells 43 of the group with the higher pressure $p_2$ are marked with dashed lines in FIG. 17.

Figure 18:
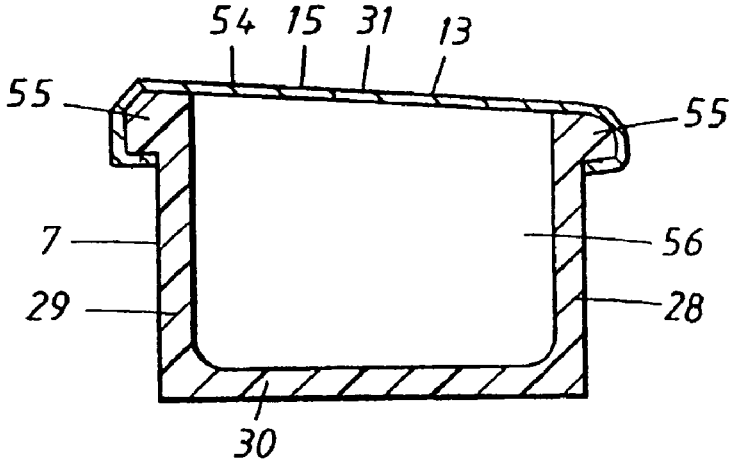
FIG. 18 shows a press body according to a eighth embodiment.

FIG. 18 shows a press body 7 which is similar to the one in FIGS. 6 and 7, but which is made of two parts, enclosing a pressure chamber 56 which is similar to the one in FIGS. 6 and 7, and of which one part includes the two side walls 28, 29 and the bottom wall 30 of the press body, whereas the other part includes the top wall 31 of the press body, exhibiting the form of a thin layer or membrane 54, wherein the side walls 28, 29 are designed with flange portions 55 for fixing the membrane 54 along its edge portions. The press body 7 in FIG. 18 functions in the same way as the one in FIGS. 6 and 7. The first part 28, 29, 30 consists of an elastic material. The membrane 54 can consist of any material, also material which has a low elasticity, e.g. metal, but still is deformable when expanding the side walls 28, 29 in order to cause its press surface 13 to adapt to the counter-pressure surface 4 and return to its initial position when the tensile forces in the side walls 28, 29 cease to act when reducing the pressure in the pressure chamber 56.

When the support body 7 has a plurality of pressure chambers (as those according to FIGS. 12 and 14) one or more pressure chambers, but not all, can be kept under atmospheric pressure, while at least one pressure chamber simultaneously has an increased or higher pressure when such a specific loading profile is desired.

Figure 19:
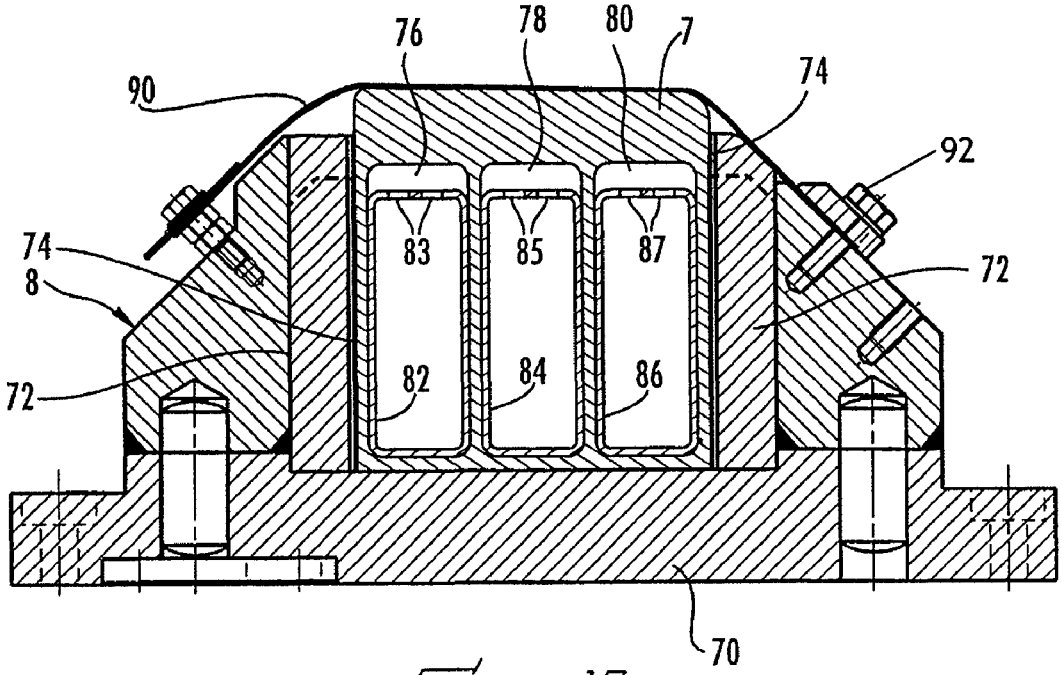
FIG. 19 is a cross-sectional view through a press body according to a ninth embodiment of the invention, in a pressurized condition.
Figure 20:
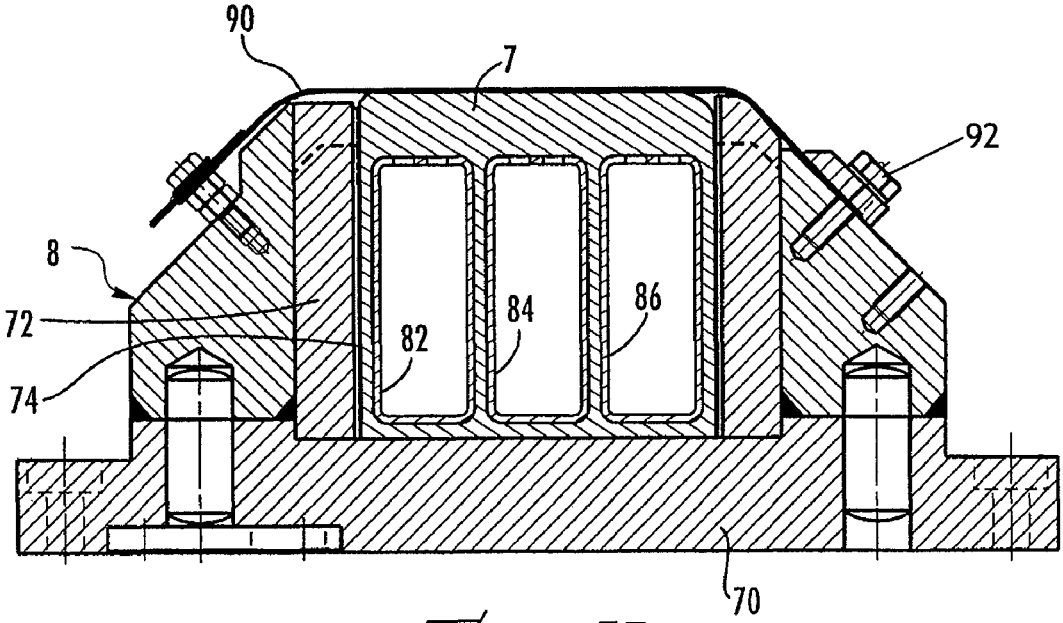
FIG. 20 shows the press body of FIG. 19 in a non-pressurized condition.

FIGS. 19 and 20 depict a press body in accordance with a ninth embodiment of the invention. The press body includes an elastically deformable support body 7 supported in a counter support or holding device 8 generally as in the previously described embodiments. The holding device 8 includes a base plate 70 whose upper surface defines a recess extending in the cross-machine direction in which the support body 7 is disposed with a lower surface of the support body 7 against the upper surface of the base plate 70. The support body 7 is narrower in the machine direction than the recess in the base plate 70, there being a space between each of the upstream and downstream sides of the support body 7 and the adjacent wall of the recess. A spacer 72 and a shim 74 are employed on each side of the support body 7 to fill the space such that the support body is securely held in the recess substantially without any "play". As in the embodiment described in connection with FIG. 3, the opposite ends of the support body 7 have reduced height and extend beneath clamping plates (not shown in FIGS. 19 and 20, but see clamping plates 24 in FIG. 3) affixed to the holding device 8 for fixing the support body 7 in the holding device.

The support body 7 is an extruded member defining three separate pressure chambers 76, 78, 80 extending in the cross-machine direction and spaced apart in the machine direction. Each of the chambers 76, 78, 80 has a generally rectangular cross-sectional shape. An internal reinforcing tube 82 of generally rectangular cross-sectional shape is embedded within the chamber 76. The reinforcing tube 82 comprises a continuous steel profile. The top wall of the reinforcing tube 82 has holes 83 spaced apart in the cross-machine direction along the tube for communicating fluid pressure from the interior of the tube 82 to the chamber 76.

Similarly, an internal reinforcing tube 84 is embedded within the chamber 78 and has holes 85 in its top wall for communicating fluid pressure from the interior of the tube 84 to the chamber 78, and an internal reinforcing tube 86 is embedded within the chamber 80 and has holes 87 in its top wall for communicating fluid pressure from the interior of the tube 86 to the chamber 80.

Separate sources of fluid can be coupled respectively to the interiors of the reinforcing tubes 82, 84, 86 for pressurizing the chambers 76, 78, 80 independently of one another. FIG. 19 shows the support body 7 in a pressurized condition, while FIG. 20 shows the support body 7 in a non-pressurized condition. The separate sources of fluid can have different pressures for influencing the machine-direction profile of the upper surface of the support body 7 in different ways for influencing the machine-direction pressure curve in the nip in different ways.

The press body can further include an exchangeable wear protection layer 90 that covers the contact surface of the support body 7. The wear protection layer comprises a flexible sheet of suitable material such as a polymer film. The wear protection layer can be removed and replaced with a new layer when it becomes worn. In this manner, wear of the support body 7 is substantially prevented and the press body can be easily and inexpensively restored to a like-new condition. The upstream edge of the wear protection layer 90 is rigidly affixed to an upstream side of the holding device, such as by fasteners 92 or the like. The downstream edge of the wear protection layer 90 can be left free to follow movement and deformation of the support body 7.

Figure 21:
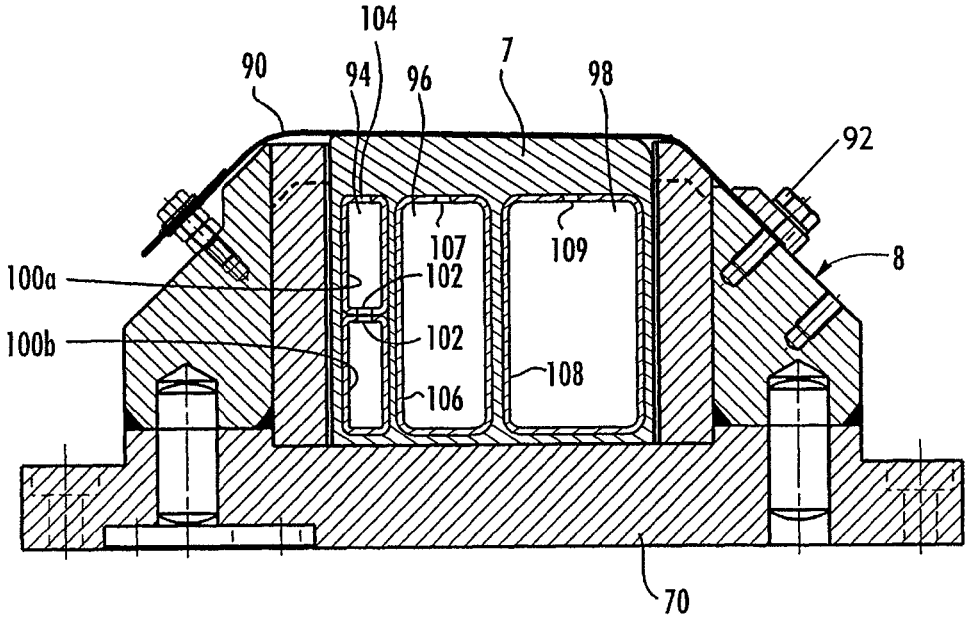
FIG. 21 is a cross-sectional view through a press body according to a tenth embodiment of the invention, in a non-pressurized condition.

A press body in accordance with a tenth embodiment of the invention is illustrated in FIG. 21, and is generally similar to the ninth embodiment of FIGS. 19 and 20 except as noted. The support body 7 in the ninth embodiment includes three pressure chambers of equal size and shape. In contrast, in the embodiment of FIG. 21 the support body 7 includes three pressure chambers 94, 96, 98 of different sizes and shapes. More particularly, the downstream chamber 94 has the smallest machine-direction dimension of the three chambers, and thus has the highest aspect ratio (i.e., the ratio of the height to the machine-direction dimension) of the three chambers. The middle chamber 96 has a larger machine-direction dimension and thus a lower aspect ratio than the downstream chamber 94, and the upstream chamber 98 has the largest machine-direction dimension and thus the lowest aspect ratio of the three chambers.

The downstream chamber 94, because of its high aspect ratio, includes a pair of reinforcing tubes 100*a* and 100*b* stacked one atop the other and rigidly joined together, such as by welding or the like. Each tube 100*a*, 100*b* has a height that is substantially half the height of the chamber 94 in its non-pressurized condition. This arrangement provides increased bending stiffness relative to a single reinforcing tube of full height. Holes 102 are provided between the tubes 100*a*, 100*b* for communicating fluid between their interiors. A series of holes 104 are formed in the top wall of the upper tube 100*a* for communicating fluid from the interiors of the tubes 100*a*, 100*b* to the interior of the chamber 94.

The middle chamber 96 includes an internal reinforcing tube 106 having holes 107 in its top wall, and the upstream chamber 98 includes an internal reinforcing tube 108 having holes 109 in its top wall. As in the ninth embodiment, the interiors of each of the reinforcing tubes 100*a/b*, 106, 108 can be supplied with separate fluid streams, which optionally can have different pressures, for pressurizing the chambers 94, 96, 98 independently of one another.

Figure 22:
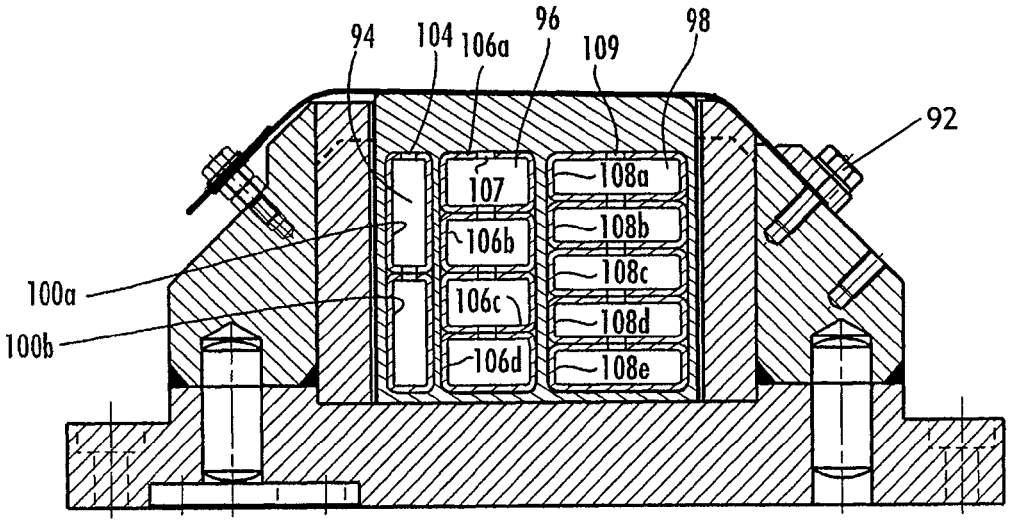
FIG. 22 is a cross-sectional view through a press body according to an eleventh embodiment of the invention, in a non-pressurized condition.

Finally, an eleventh embodiment of a press body in accordance with the invention is depicted in FIG. 22. This embodiment is generally similar to the tenth embodiment except as noted. The pressure chambers 94, 96, 98 are of the same sizes and shapes as in the tenth embodiment, and the reinforcing tubes 100*a*, 100*b* for the downstream chamber 94 are the same, but the configurations of the reinforcing tubes for the middle and upstream chambers 96, 98 are different. In particular, the middle chamber 96 has a stack of four separate reinforcing tubes 106*a*, 106*b*, 106*c*, 106*d* stacked one atop another and rigidly joined together by welding or the like. There are holes between the contiguous tubes 106*a* and 106*b*, between the contiguous tubes 106*b* and 106*c*, and between the contiguous tubes 106*c* and 106*d*, for communicating fluid between the respective interiors of the contiguous tubes. The top tube 106*a* has holes 107 as in the prior embodiment.

The upstream chamber 98 has a stack of five separate reinforcing tubes 108*a*, 108*b*, 108*c*, 108*d*, 108*e* stacked one atop another and rigidly joined together. There are holes between the contiguous tubes 108*a* and 108*b*, between the contiguous tubes 108*b* and 108*c*, between the contiguous tubes 108*c* and 108*d*, and between the contiguous tubes 108*d* and 108*e* for communicating fluid between the respective interiors of the contiguous tubes. The top tube 108*a* has holes 109 as in the prior embodiment.

The press body according to the invention has a number of essential advantages of which the following can be mentioned:

It is self-conforming to the outline of the counter-pressure surface.

It conforms to and follows the deformation of the counter-pressure surface.

It avoids abnormal wear of the edges of the press felt.

It is forgiving to e.g. a paper wad passing through the press nip.

It can be manufactured at a very low cost.

It can be designed for controlling the load within the entire press nip, or within successive sections of the press nip and independently of each other.

The support bodies 7 which are described above and shown in the drawings have been designated press bodies, since they are used in a press apparatus. Naturally, the same embodiments of the press body can be used in other apparatus for the treatment of a fibre web in a paper or board machine, or in a calendar. When the invention is applied to e.g. a wire section, the belt 6 of the first press element 1 in FIG. 1 can be replaced with a clothing, such as e.g. a wire.

The load in the nip can vary from 0 to 3000 kN/m.

The support body may have a dimension in the machine direction (width) which typically is 50-500 mm.

The desirable elastic properties of the support body are achieved by means of an elastic material, having a coefficient of elasticity which is substantially lower than that of metal, such as steel and aluminium, so that the support body, depending on the construction of the support body, can be elastically expanded or elastically compressed. Typical hardness values of the elastic material is 50-95 Shore A. The elastic material should also give the support body a sufficient strength/hardness in order to withstand wear, but at the same time make the support body elastically deformable enough in order to obtain the desired function according to the invention. As elastic materials, plastic and rubber materials can be used, such as polymers, composite materials, which can be reinforced with e.g. glass fibres, carbon fibres or textile. At present, polyurethane is a preferred polymer.

In some of the embodiments described above, the holding device 8 functions as an outer counter support for all surfaces, as seen circumferentially, of the support body 7 except its contact surface 13. It can also be designed and arranged such that it functions as an inner counter support which is entirely or partially embedded in the support body at a distance from the pressure chamber or pressure chambers, respectively. Also the combination of an outer counter support and an inner counter support can be used, such as in the embodiments of FIGS. 19 through 22.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A support body assembly for an apparatus having an extended nip defined in part by a counter-pressure surface, comprising:

a support body defining a press surface that forms said extended nip with the counter-pressure surface and adopts the outline of the counter-pressure surface over an entire length of the extended nip in a machine direction thereof, said support body being elastically deformable and comprising at least one pressure chamber that is arranged to be pressurized in order to load the nip via said press surface; and a counter support for the support body, the counter support providing support to sides of the at least one pressure chamber except at a side of the pressure chamber facing said press surface so that pressurization of the pressure chamber causes the pressure chamber to expand in the direction of said press surface.

2. The support body assembly according to claim 1, wherein the counter support comprises an outer counter support for all surfaces, as seen circumferentially, of the support body except said press surface, and an inner counter support that is embedded in the support body.

3. The support body assembly according to claim 1, the support body being arranged such that a change of the pressure in said at least one pressure chamber produces a corresponding change of pressure in the nip.

4. The support body assembly according to claim 1, wherein said counter support is formed by a holding device.

5. The support body assembly according to claim 4, wherein the support body is mounted in a starting position with said press surface at a touch-free distance from the counter-pressure surface, and wherein pressurizing of the at least one pressure chamber causes the support body to expand so as to move the press surface in the direction of the counter-pressure surface for obtaining a nip-forming operation position, the holding device being arranged to form said counter support also during said expansion of the support body.

6. The support body assembly according to claim 4, wherein the support body is mounted in a first starting position with said press surface at a touch-free distance from the counter-pressure surface, and wherein the holding device and the support body are arranged to be moved together by means of a movement transmitting member in the direction toward the counter-pressure surface to a second starting position with the press surface of the support body in contact with or nearly in contact with the counter-pressure surface, and wherein pressurizing of the at least one pressure chamber causes the support body to expand for obtaining a nip-forming operation position, the holding device being arranged to form said counter support also during said expansion of the support body.

7. The support body assembly according to claim 1, wherein the support body defines several closed pressure chambers, wherein:

each pressure chamber defines an opposed contact zone of said press surface;

the support body has a deformable top wall that defines said press surface and is arranged for being actively influenced by the pressure in the pressure chambers, two elastically deformable outer side walls connected to said top wall and arranged for expanding elastically under increased pressure in the pressure chambers in order to displace the top wall, and a bottom wall connected to the two outer side walls.

8. The support body assembly according to claim 7, wherein the two outer side walls have the same elasticity.

9. The support body assembly according to claim 7, wherein the two outer side walls have different elasticity.

10. The support body assembly according to claim 9, wherein the outer side walls have different thickness and/or consist of the same or different elastic materials.

11. The support body assembly according to claim 7, wherein the pressure chambers are axially through-going and are separated by partition walls.

12. The support body assembly according to claim 11, wherein the support body includes at least four pressure chambers separated by longitudinal partition walls and transversal partition walls.

13. The support body assembly according to claim 7, wherein the pressures in the pressure chambers are arranged for being regulated in accordance with a predetermined pattern for obtaining a desired press curve.

14. The support body assembly according to claim 11, wherein at least one of the partition walls includes a reinforcement member arranged to withstand a pressure difference between two pressure chambers separated by the partition wall.

15. The support body assembly according to claim 14, wherein the reinforcement member consists of a rigid material and is integrated into the partition wall or received in a corresponding groove or recess in the partition wall.

16. The support body assembly according to claim 1, wherein the support body is made of a plastic material or rubber material including polymer with or without reinforcing fiber or textile material.

17. The support body assembly according to claim 7, wherein at least said outer side walls consist of an elastic material in the form of a polymer.

18. The support body assembly according to claim 17, wherein the support body is made in one piece.

19. The support body assembly according to claim 1, wherein the support body is adapted to operate at a load in the nip that varies from 0 to 3000 kN/m.

20. The support body assembly according to claim 1, wherein the support body has a dimension in the machine direction of 50-500 mm.

21. The support body assembly according to claim 1, wherein the counter support is structured and arranged to support all surfaces, as seen circumferentially, of the support body except said press surface.

22. The support body assembly according to claim 4, wherein the holding device has a space for receiving the support body in order to form an outer counter support for all surfaces of the support body, as seen circumferentially, except said press surface.

23. The support body assembly according to claim 4, wherein the holding device is entirely or partially embedded in the support body in order to form an inner counter support for all sides of the at least one pressure chamber except the side facing said press surface.

24. A support body assembly for an apparatus having an extended nip defined in part by a counter-pressure surface, comprising:

a support body defining a press surface that forms said extended nip with the counter-pressure surface, said support body being elastically deformable and comprising at least one pressure chamber that is arranged to be pressurized in order to load the nip via said press surface; and a counter support for the support body, the counter support providing support to sides of the at least one pressure chamber except at a side of the pressure chamber facing said press surface so that pressurization of the pressure chamber causes the pressure chamber to expand in the direction of said press surface, wherein the counter support comprises an inner counter support that is embedded in the support body.

25. The support body assembly according to claim 24, wherein the inner counter support comprises a continuous metal profile embedded in the support body.

26. The support body assembly according to claim 25, wherein the continuous metal profile comprises a tube disposed within the at least one pressure chamber, a side wall of the reinforcing tube including holes for communicating fluid between an interior of the reinforcing tube and the at least one pressure chamber.

27. The support body assembly according to claim 24, wherein the support body defines a plurality of pressure chambers separate from one another and spaced apart in a machine direction along which a web passes through the nip, and wherein each pressure chamber includes at least one continuous metal profile disposed therein as an inner counter support.

28. The support body assembly according to claim 27, wherein the at least one continuous metal profile disposed in each pressure chamber comprises a reinforcing tube, a side wall of the reinforcing tube including holes for communicating fluid between an interior of the reinforcing tube and the respective pressure chamber.

29. The support body assembly according to claim 28, wherein at least one of the pressure chambers has a plurality of separate reinforcing tubes disposed therein and rigidly joined together.

30. The support body assembly according to claim 29, wherein the interiors of contiguous ones of the plurality of rigidly joined reinforcing tubes are in fluid communication with one another via holes extending between the reinforcing tubes.

31. A support body assembly for an apparatus having an extended nip defined in part by a counter-pressure surface, comprising:

a support body defining a press surface that forms said extended nip with the counter-pressure surface, said support body being elastically deformable and comprising at least one pressure chamber that is arranged to be pressurized in order to load the nip via said press surface; and a counter support for the support body, the counter support providing support to sides of the at least one pressure chamber except at a side of the pressure chamber facing said press surface so that pressurization of the pressure chamber causes the pressure chamber to expand in the direction of said press surface, wherein said counter support is formed by a holding device, wherein the press surface of the support body is covered by an exchangeable, thin wear protection layer having one side edge portion rigidly affixed to an upstream side of the holding device and an opposite side edge portion that is free to follow movement and deformation of the support body.

32. An apparatus for the treatment of a fiber web being manufactured in a paper or board machine, comprising:

a first structural element, and a second structural element movably arranged with respect to the first structural element and having a counter-pressure surface for interaction with the first structural element to form an extended nip, said first structural element including:

a movable clothing;

a support body having a press surface that together with the counter-pressure surface defines an entire length of said nip in a machine direction thereof, said support body being elastically deformable and comprising at least one pressure chamber that is arranged to be pressurized in order to load the nip via said press surface; and a counter support for the support body, the counter support providing support to sides of the at least one pressure chamber except at a side of the pressure chamber facing said press surface so that pressurization of the pressure chamber causes the pressure chamber to expand in the direction of said press surface so as to load the nip with accompanying changed press curve, wherein the press surface conforms to and adopts the outline of the counter-pressure surface over the entire length of the nip in the machine direction.

33. The apparatus according to claim 32, wherein said counter support is formed by a holding device.

34. The apparatus according to claim 32, wherein the support body defines several closed pressure chambers, wherein:

each pressure chamber defines an opposed contact zone of said press surface; and the support body has a deformable top wall that defines said press surface and is arranged for being actively influenced by the pressure in the pressure chambers, two elastically deformable outer side walls connected to said top wall and arranged for expanding elastically under increased pressure in the pressure chambers in order to displace the top wall, and a bottom wall connected to the two outer side walls.

35. The apparatus according to claim 32, wherein the second structural element also includes said support body defining a press surface constituting said counter-pressure surface.

36. A press for the treatment of a fiber web being manufactured in a paper or board machine, comprising:

a first press element, and a second press element movably arranged with respect to the first press element and having a counter-pressure surface for interaction with the first press element to form an extended press nip, said first press element including:

a movable belt;

a press body defining a press surface that together with the counter-pressure surface defines an entire length of said nip in a machine direction thereof, said press body being elastically deformable and comprising at least one pressure chamber that is arranged to be pressurized in order to load the nip via said press surface; and a counter support for the press body, the counter support providing support to sides of the at least one pressure chamber except at a side of the pressure chamber facing said press surface so that pressurization of the pressure chamber causes the pressure chamber to expand in the direction of said press surface so as to load the nip with accompanying changed press curve, wherein the press surface conforms to and adopts the outline of the counter-pressure surface over the entire length of the nip in the machine direction.

37. The press according to claim 36, wherein said counter support is formed by a holding device.

38. The press according to claim 36, wherein the counter-pressure surface and/or the press surface is/are arranged to be heated.

39. The press according to claim 36, wherein the press body defines several closed pressure chambers, wherein:

each pressure chamber defines an opposed contact zone of said press surface; and the press body has a deformable top wall that defines said press surface and is arranged for being actively influenced by the pressure in the pressure chambers, two elastically deformable outer side walls connected to said top wall and arranged for expanding elastically under increased pressure in the pressure chambers in order to displace the top wall, and a bottom wall connected to the two outer side walls.

40. The press according to claim 39, wherein an upstream one of the outer side walls has a smaller elasticity than a downstream one of the outer side walls.

41. The press according to claim 36, wherein the second press element also includes said press body defining a press surface constituting said counter-pressure surface.

42. A method of forming an extended nip in an apparatus, comprising a support body defining a press surface, wherein said nip is to be defined by said press surface and a counter-pressure surface, said support body being elastically deformable and comprising at least one pressure chamber that is arranged to be pressurized in order to load the nip via said press surface, wherein the method comprises the steps of:

mounting the support body in a holding device that forms a counter support for a bottom portion and side portions of the support body;

applying an increased pressure in said at least one pressure chamber; and displacing a top portion of the support body defining said press surface in a direction towards the counter-pressure surface under the influence of said increased pressure, by means of expansion of said side portions of the support body, said side portions being elastically deformable and connected to the top portion, wherein said press surface together with said counter-pressure surface defines an entire length of said nip in a machine direction thereof.

43. A method of controlling the load in an extended nip in an apparatus, including a support body defining a press surface, said nip being defined by said press surface and a counter-pressure surface, said support body being elastically deformable and comprising a plurality of pressure chambers that are arranged to be pressurized independently of one another in order to load the nip via said press surface, wherein the method comprises the steps of:

mounting the support body in a holding device that forms a counter support for a bottom portion and side portions of the support body; and setting the pressures in the pressure chambers in accordance with a predetermined pattern to obtain a desired press curve.

44. The method according to claim 43, wherein the pressure chambers are defined by partition walls, extending both in the machine direction and crosswise to the machine direction in order to obtain groups of pressure chambers, and wherein the pressures in each group of pressure chambers are set independently of the pressures in the other group or groups.

45. A method according to claim 44, wherein the load in the press nip is controlled independently in the machine direction and/or crosswise to the machine direction.

46. A support body for an apparatus having an extended nip defined in part by a counter-pressure surface, comprising:

a support body defining a press surface that together with the counter-pressure surface defines an entire length of said nip in a machine direction thereof, said support body being elastically deformable and comprising a plurality of pressure chambers separate from one another and spaced apart in a machine direction along which a web passes through the nip, said pressure chambers being arranged to be pressurized in order to load the nip via said press surface, wherein the press surface conforms to and adopts the outline of the counter-pressure surface over the entire length of the nip in the machine direction.

47. The support body of claim 46, wherein each pressure chamber includes at least one continuous reinforcing profile disposed therein as an inner counter support.

48. The support body of claim 47, wherein each inner counter support comprises a continuous metal profile embedded in the support body.

49. The support body of claim 48, wherein each continuous metal profile comprises a tube disposed within the respective pressure chamber, a side wall of the reinforcing tube including holes for communicating fluid between an interior of the reinforcing tube and the pressure chamber.

50. The support body of claim 49, wherein at least one of the pressure chambers has a plurality of separate reinforcing tubes disposed therein and rigidly joined together.

51. The support body of claim 50, wherein the interiors of contiguous ones of the plurality of rigidly joined reinforcing tubes are in fluid communication with one another via holes extending between the reinforcing tubes.

* * * * *